US007246543B1

(12) United States Patent
Patti

(10) Patent No.: US 7,246,543 B1
(45) Date of Patent: Jul. 24, 2007

(54) MULTI-FUNCTION ADJUSTABLE WRENCH

(76) Inventor: Frank Richard Patti, 5550 Lobos La., Atascadero, CA (US) 93422

( * ) Notice: Subject to any disclaimer, the term of this patent is extended or adjusted under 35 U.S.C. 154(b) by 0 days.

(21) Appl. No.: 11/401,796

(22) Filed: Apr. 11, 2006

Related U.S. Application Data

(60) Provisional application No. 60/741,340, filed on Nov. 30, 2005.

(51) Int. Cl.
*B25B 13/00* (2006.01)

(52) U.S. Cl. ..... 81/124.5; 81/124.4; 81/125.1; 81/177.1; 81/177.7

(58) Field of Classification Search ..... 81/124.4, 81/124.5, 125.1, 177.1, 177.7
See application file for complete search history.

(56) References Cited

U.S. PATENT DOCUMENTS 1,805,298 A * 5/1931 Schweigert ..... 81/177.8
6,330,842 B1 * 12/2001 Brun ..... 81/57.39
6,637,299 B1 * 10/2003 Steele ..... 81/124.5
7,047,844 B1 * 5/2006 Macor ..... 81/124.4
7,047,845 B2 * 5/2006 Macor ..... 81/177.1
2004/0025646 A1 2/2004 Hsien
2004/0060398 A1 4/2004 Hsien

* cited by examiner

*Primary Examiner*—Joseph J. Hail, III
*Assistant Examiner*—Shantese McDonald

(57) ABSTRACT

A multiple function adjustable wrench comprising: a shank 18 having a first end 16 with a fixed jaw 12, a adjustable jaw 10, and a adjusting screw 14. The adjusting screw 14 moves the adjustable jaw 10 toward and away from the fixed jaw 12. Two arms 20*a*, 20*b* extend from the second end 38 of the shank 18. A ratchet box 22 includes a first engaging socket 24*a* that is rotatably engaged with a first engaging hole of the ratchet box 22. The ratchet 22 also includes a second engaging socket 26*a* having a different inner diameter is rotatably engaged with a second engaging hole of the ratchet box 22. The first engaging socket, and the second engaging socket have a engaging hole defined therethrough. The engaging hole can be toothed so as to form a 12-point engaging socket or square so as to form a square engaging socket. Ratchet mechanisms (not shown) are received in the ratchet box 22 and are cooperated with each engaging socket. The ratchet box 22 is rotatably connected within the two arms 20*a*, 20*b* with a engaging member such as a pin 30.

5 Claims, 6 Drawing Sheets

MULTI-FUNCTION ADJUSTABLE WRENCH

CROSS REFERENCE TO RELATED APPLICATIONS

This application claims the benefit of disclosure document 580921 filed on 2005 Jun. 27, disclosure document 590478 filed on 2005 Nov. 23, and provisional patent application Ser. No. 60/741,340 filed on 2005 Nov. 30 by the present inventor.

FEDERALLY SPONSORED RESEARCH

Not Applicable

SEQUENCE LISTING OR PROGRAM

Not Applicable

BACKGROUND OF THE INVENTION

1. Field of Invention

The present invention relates to wrenches, more specifically to a multi-function adjustable wrench.

2. Prior Art

Adjustable wrenches have been in use for over 100 years and are manufactured in a variety of lengths, 4-inch thru 24-inch. These wrenches are very simple and useful to use. The capacity of adjustment depends on the length of the wrench.

A adjustable wrench includes; a shank, a fixed jaw, and a adjustable jaw. A adjusting screw moves the adjustable jaw toward and away from the fixed jaw. There is a wide range of adjustment between the fixed jaw and the adjustable jaw to meet a wide range of different diameter fasteners to be tightened or loosened. The range of adjustment depends on the length of the wrench. This wrench does require the user to release the wrench from the fastener after the first stroke, or turn, and reposition the wrench on the fastener at a convenient angle for the second stroke.

Boxed ratchet wrenches have been in use for over 50 years and are very popular. This wrench includes a shank and a ratchet box with a engaging socket rotatably engaged with the ratchet box. A ratchet mechanism is received in the ratchet box and cooperated with the engaging socket. This wrench allows the user to tighten or loosen in one direction, and ratchet the shank back in the opposite direction. This wrench does not require the user to remove the wrench from the fastener for repositioning. These wrenches come in a variety sizes and styles. Sizes range from ¼" through 1" diameter open-end socket, and metric sizes. The styles include a flat, a fixed offset, and a pivot. The pivot allows the user to create any angle of offset. Further they are available with, or without reversing levers. The non-reversing lever type requires the user to flip the wrench over for reverse operation.

A patent search revealed that one other individual has thought to incorporate these two wrenches together. The said individual filed two patent applications. The following is representative of the prior art.

U.S. Patent Application 20040025646 filed by Hsien on 2004 Feb. 12 describes an adjustable wrench with one multiple sized socket rotatably engaged within the handle end of the wrench.

U.S. Patent Application 20040060398 filed by Hsien on 2004 Apr. 1 describes an adjustable wrench having one multiple sized socket rotatably engaged within a pivotable ratchet box mounted on the handle end of the wrench.

I originally invented three ways of incorporating a adjustable wrench and a boxed ratchet wrench. My first two ideas turned out to be too similar to the prior art. The present invention is my third idea.

The present invention intends to provide a adjustable wrench at the first end of a shank, and a ratchet box that is rotatably connected at the second end of the shank. The ratchet box includes two different inner diameter engaging sockets.

BACKGROUND OF THE INVENTION: OBJECTS AND ADVANTAGES

Several objects and advantages of the present invention are:

(a) To provide a multi-function wrench with the ability to tighten or loosen a wide variety of different diameter fasteners with the adjustable end of the shank, and the time saving convenience of having a ratchet box with two different inner diameter engaging sockets at the other end of the shank.

(b) A wide variety of size combinations are possible utilizing different sized adjustable wrenches combined with a ratchet box with two different inner diameter engaging sockets.

(c) Ideal for the professional tradesperson who carries a tool bag with limited space.

(d) The ratchet box utilizes 12-point and square engaging sockets. Further they can be single or double sized type. Two 12-point single sized engaging sockets are shown for example.

(e) The novice to the professional can use the ratchet box utilizing 12-point engaging sockets.

(f) The ratchet box utilizing square sockets would be ideal for the HVAC-R tradesperson. These tradespeople work with service valves on most if not all equipment being worked on. These service valves are used to close off a line or connect service gages. Each service valve consists of a removable cap to connect service gages and a different diameter removable cap to expose a valve stem post with a male square head. Most if not all fellow tradespeople use an adjustable wrench to remove the two different diameter caps, and then use a boxed ratchet wrench with square sockets to move the valve stem. It takes two separate wrenches to perform this task. Combining these two wrenches together would be very convenient. Still further objects and advantages will become apparent from a consideration of the ensuing description and drawings.

SUMMARY

In accordance with the present invention, a multi-function adjustable wrench includes; a shank having a first end with a fixed jaw, and a adjustable jaw. A adjusting screw moves the adjustable jaw toward and away from the fixed jaw. Two arms extend from the second end of the shank. A ratchet box is rotatably connected within the two arms with a pin. The ratchet box includes two different inner diameter engaging sockets. Each socket is rotatably engaged with the ratchet box. Each engaging socket has a engaging hole defined therethrough.

DRAWINGS: FIGURES

Figure 5:
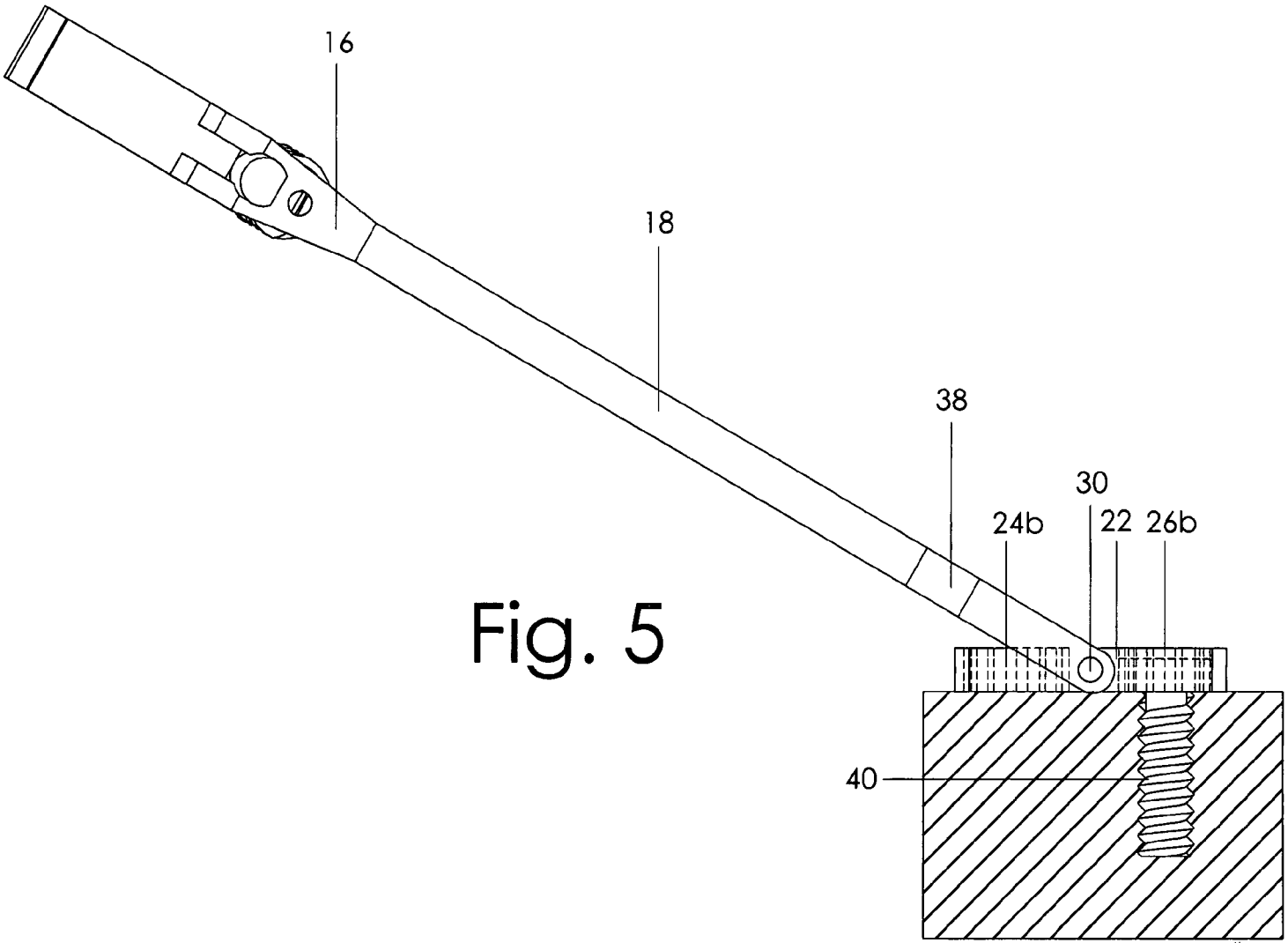

FIG. 5 also shows a plan view of the present invention with engaging teeth attached to a fastener.

Figure 6:
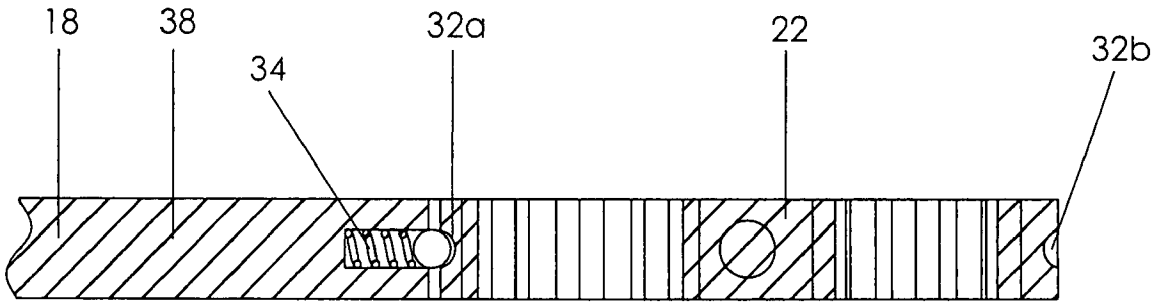

FIG. 6 shows a cut plan view of the present invention with an optional spring and ball mechanism and female half circle catches.

FIGS. 7A, 7B, 8A, 8B show additional engaging sockets.

DRAWINGS: REFERENCE NUMBERS

10 adjustable jaw
12 fixed jaw
14 adjusting screw
16 first end
18 shank
20*a* arm
20*b* arm
22 ratchet box
24*a* first engaging socket
24*b* teeth
26*a* second engaging socket
26*b* teeth
28 interior passage
30 pin
32*a* female half circle catch
32*b* female half circle catch
34 spring and ball mechanism
36*a* interior passage
36*b* interior passage
38 second end
40 fastener DETAILED DESCRIPTION: FIGS. 1, 2, 3, 4, 5
PREFERRED EMBODIMENT Referring to FIG. 1 of the present invention, a multi-function adjustable wrench includes; a shank 18 having a first end 16, a fixed jaw 12, and a adjustable jaw 10. The adjusting screw 14 moves the adjustable jaw 10 toward and away from the fixed jaw 12. This enables the user to tighten or loosen a wide variety of different diameter fasteners. The range of adjustment depends on the length of the wrench.

Figure 1:
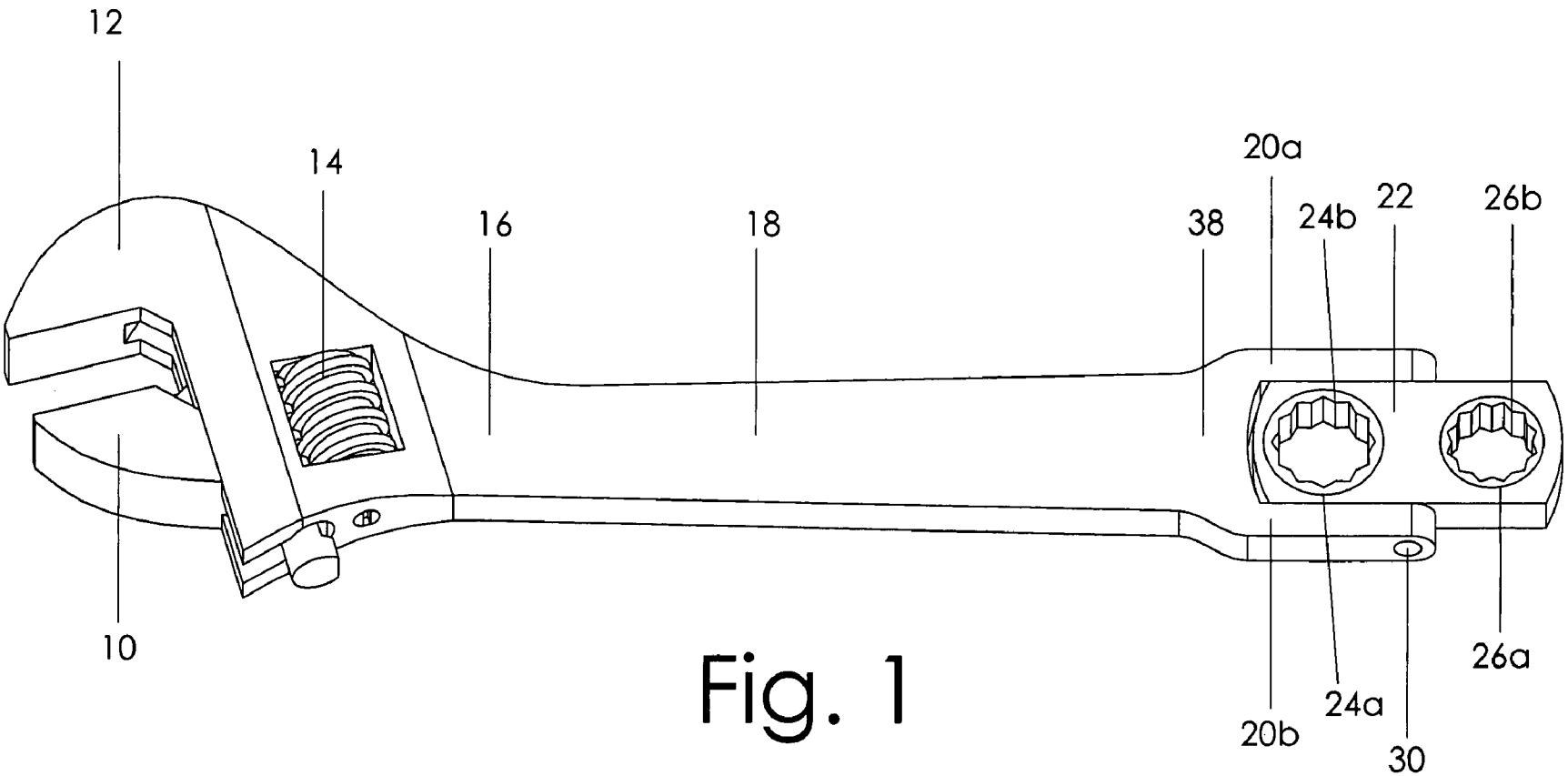
FIG. 1 shows a perspective view of the present invention.

Referring to FIG. 1 of the multi-function adjustable wrench, two arms 20*a*, 20*b* extend from the second end 38 of the shank 18. A ratchet box 22 is rotatably connected within the two arms 20*a*, 20*b* with a engaging member such as a pin 30.

Referring to FIG. 1 of the multi-function adjustable wrench, a ratchet box 22 includes; a first engaging socket 24*a* is rotatably engaged with a first engaging hole of the ratchet box 22. A second engaging socket 26*a* having a different inner diameter is rotatably engaged with a second engaging hole of the ratchet box 22. The first engaging socket 24*a* and the second engaging socket 26*a* have a engaging hole defined therethrough. Teeth 24*b* form a toothed engaging hole of the first engaging socket 24*a*. Teeth 26*b* form a toothed engaging hole of the second engaging socket 26*a*. Two single sized 12-point engaging sockets are shown for example. Ratchet mechanisms (not shown) are received in the ratchet box 22, and are cooperated with the first engaging socket 24*a* and the second engaging socket 26*a*. The user is required to flip the wrench over for reverse operation of the socket being used.

Figure 2:
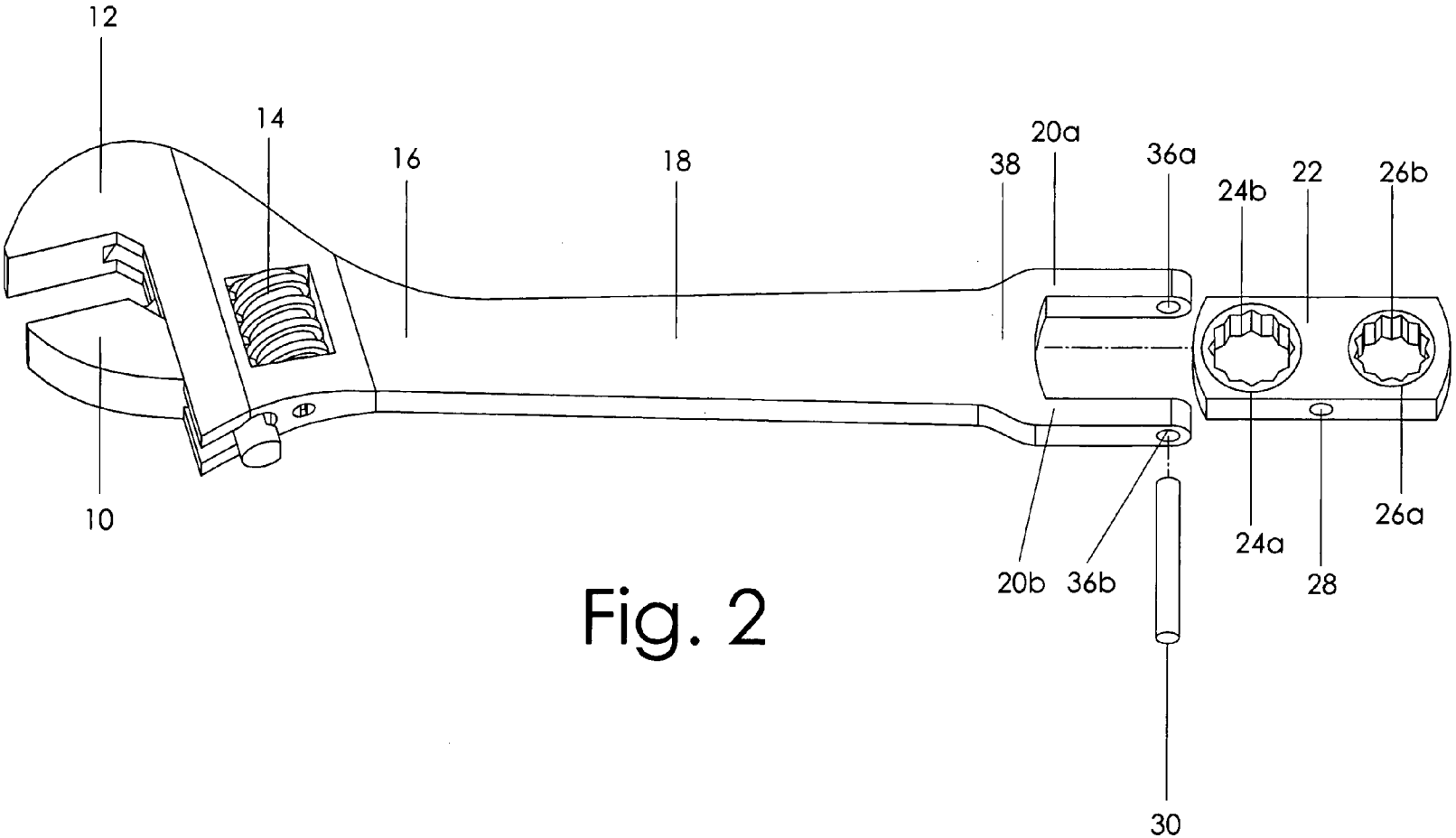
FIG. 2 shows another perspective view of the present invention.

Referring to FIG. 2, this shows how the ratchet box 22 is rotatably connected within the two arms 20*a*, 20*b*. The pin 30 passes through interior passage 36*b*, of the arm 20*b*, through interior passage 28 of the ratchet box 22, and through interior passage 36*a* of the arm 20*a* for a stiff fit.

Figure 3:
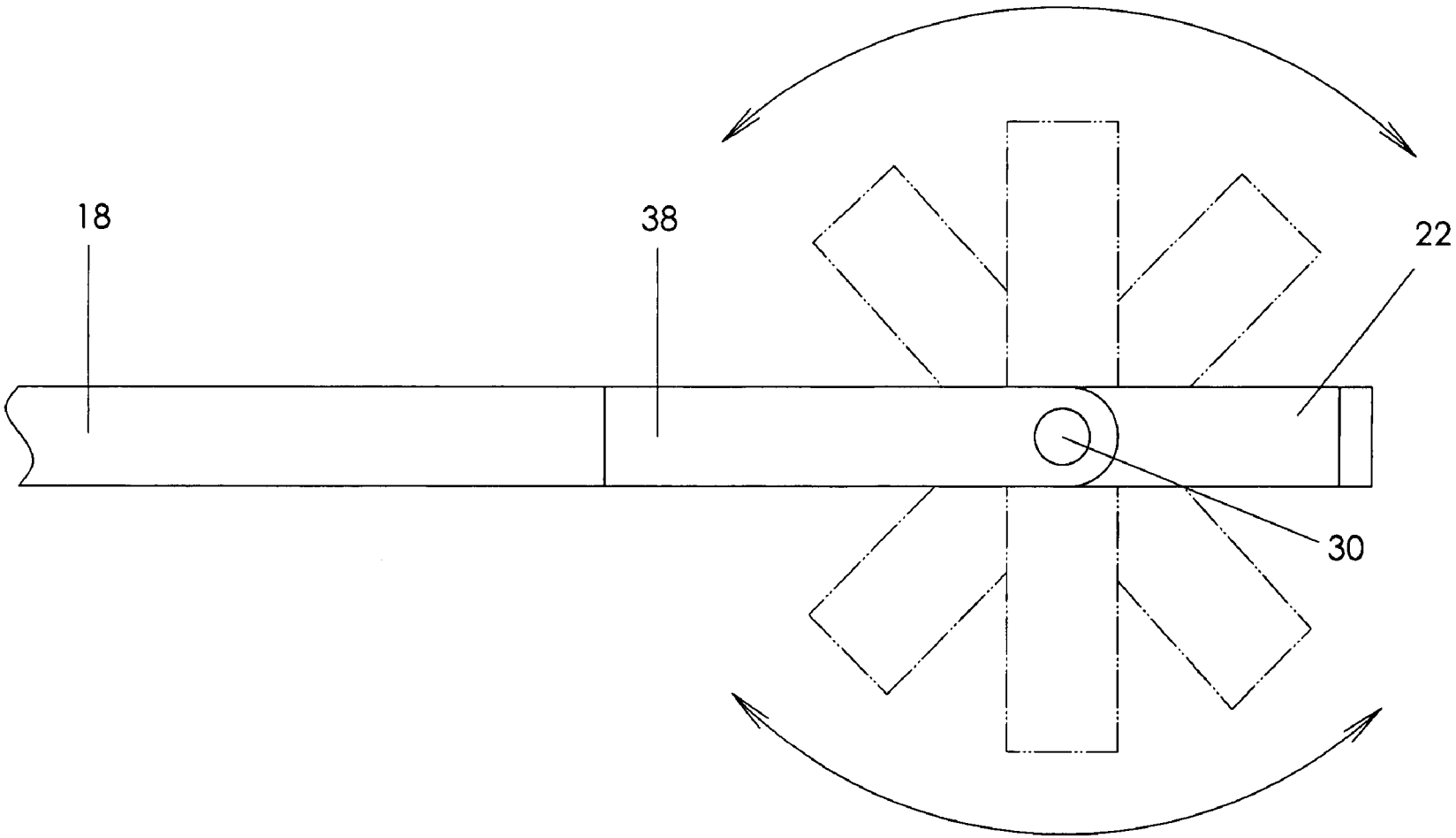
FIG. 3 shows a plan view of the second end of the shank of the present invention.

Referring to FIG. 3, this shows the second end 38 of the shank 18. The ratchet box 22 can rotate 360 degrees in either direction. With this ability, any angle of offset can be created when using the second end 38 of the shank 18 as the functional end. Rotating the ratchet box 22 would also be done to interchange socket locations. When the ratchet box 22 is rotated, it will be stiff and tight. This will give ease of use when using the second end 38 of the shank 18 as the functional end in a offset position.

Figure 4:
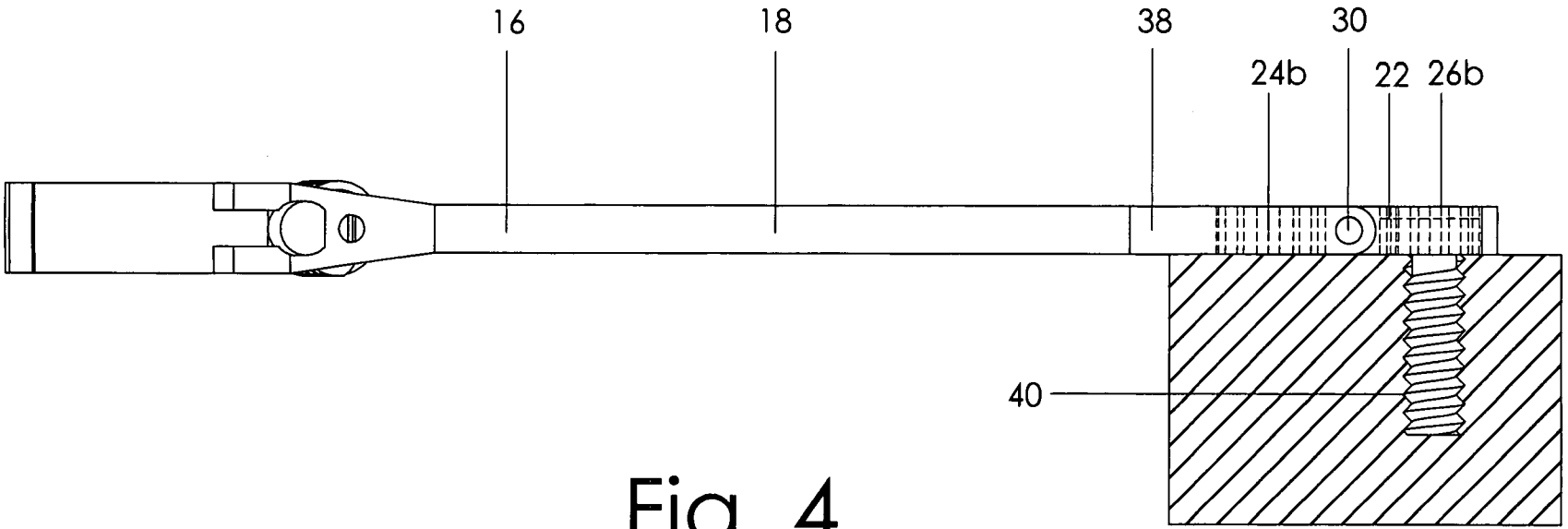
FIG. 4 shows a plan view of the present invention with engaging teeth attached to a fastener.

Referring to FIG. 4, this shows the multi-function adjustable wrench using the second end 38 of the shank 18 as the functional end. For example, I illustrate teeth 26*b* engaged to a fastener 40 with the shank in the flat position relative to the work piece.

Referring to FIG. 5, this shows the multi-function adjustable wrench using the second end 38 of the shank 18 as the functional end. For example, I illustrate teeth 26*b* engaged to a fastener 40 with the shank 18 in a offset angle relative to the work piece.

ADDITIONAL EMBODIMENTS: FIGS. 6

Referring to FIG. 6 this shows a optional spring and ball mechanism 34 and female half circle catches 32*a*, 32*b*. The spring and ball 34 may be incorporated into the second end 38 of the shank 18. Female half circle catches 32*a*, 32*b* also may be incorporated into each end of the ratchet box 22. This would be used to lock the ratchet box 22 in the flat position.

Figure 7A:
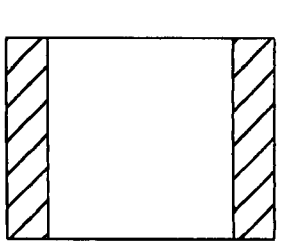

FIG. 7A shows a side cut view of a single sized square engaging socket.

Figure 7B:
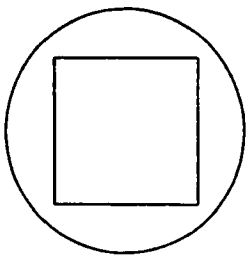

FIG. 7B shows a top view of a single sized square engaging socket.

Figure 8A:
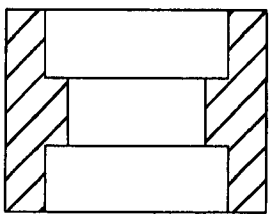

FIG. 8A shows a side cut view of a double sized square engaging socket.

Figure 8B:
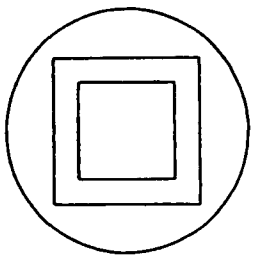

FIG. 8B shows a top view of a double sized square engaging socket.

The preferred engaging sockets to be used are 12-point and square types. The square engaging sockets are single and double sized. A 12-point engaging socket has a toothed engaging hole defined therethrough so as to form a 12-point engaging socket. A square engaging socket has a square engaging hole defined therethrough so as to form a square engaging socket. A single sized square engaging socket has a single sized square engaging hole defined therethrough so as to form a single sized square engaging socket. A double sized square engaging socket has a double sized square engaging hole defined therethrough so as to form a double sized square engaging socket.

OPERATION: FIGS. 1, 3, 4, 5

In operation, when the user desires to use the multi-function adjustable wrench with the first end 16 of the shank 18 as the functional end, the user would hold the second end 38 of the shank 18 in one hand. Place a fastener to be tightened or loosened between the fixed jaw 12 and the adjustable jaw 10. Adjust the adjusting screw 14 to a tight fit with a fastener. At the end of the first stroke, the user is required to release the fixed jaw 12 and the adjustable jaw 10 from the fastener to re-position the wrench at a convenient angle for a second stroke.

In operation, the user when desires can use the multi-function adjustable wrench with the second end 38 of the shank 18 as the functional end. The user would now hold the first end 16 of the shank 18 in one hand, engage engaging socket 26*a*, or 24*a* to a fastener 40. The user would tighten or loosen in one direction, and at the end of the first stroke, ratchet the shank 18 back in the opposite direction to a convenient angle for the second stroke.

In operation, when using the multi-function adjustable wrench with the second end 38 of the shank 18 as the functional end, the user can use as a flat style FIG. 4, or rotate the ratchet box 22 to create any angle of offset FIG. 5.

In FIGS. 4, 5 for example, I illustrate the multi-function adjustable wrench with the second end 38 of the shank 18 as the functional end. The user would hold the first end 16 of the shank 18 in one hand. Further in FIGS. 4 and 5, I illustrate the preferred location to put the desired socket for use, such as teeth 26*b* shown engaged to a fastener 40. The reason for this location is, when tightening or loosening the rounded shape of the fixed jaw 12 will apply pressure to the hand. This is true for right or left handed users, and is quite comfortable to hold. If the user desired to switch socket locations, the ratchet box 22 would simply be rotated. Keeping in mind that either socket can be used in any location. The user would be required to flip the wrench over for reverse operation for the socket being used.

SCOPE, RAMIFICATIONS, CONCLUSION

The present invention, a multi-function adjustable wrench would appeal to anybody who uses wrenches, especially the professional who carries a tool bag with limited space. The novice to the professional would use the multi-function wrench with 6-point, 12-point, or spline engaging sockets. The use of square engaging sockets would appeal to the HVAC-R tradesperson. When using a engaging socket to tighten or loosen a fastener, the shank can be in a flat position or an offset position relative to the work piece.

The following is a list of preferred size combinations for the present invention.

1. 6-inch adjustable wrench having a ratchet box with 5/16", and 3/8" 12-point single sized open-end engaging sockets.
2. 8-inch adjustable wrench having a ratchet box with 7/16", and 1/2" 12-point single sized open-end engaging sockets.
3. 10-inch adjustable wrench having a ratchet box with 9/16", and 5/8" 12-point single sized open-end engaging sockets.
4. 12-inch adjustable wrench having a ratchet box with 11/16", and 3/4" 12-point single sized open-end engaging sockets.
5. 8-inch adjustable wrench having a ratchet box with 3/16", 1/4", 5/16", 3/8" square engaging sockets. These sockets are double sized open-end types (not shown).
6. 10-inch adjustable wrench having a ratchet box with 3/8," and 1/2" square engaging sockets.

While I have shown and described the preferred and additional embodiments in accordance with the present invention, it should be clear to those skilled in the art that further embodiments may be made without departing from the scope of the present invention. Thus the scope of the invention should be determined by the appended claims rather than by the examples given.

I claim:

1. A multiple function adjustable wrench comprising:

a shank having a first end and a second end, said first end including a fixed jaw, an adjustable jaw and an adjusting screw, two arms extending from said second end, a ratchet box, rotatably connected within said two arms, said ratchet box including a first engaging socket, said first engaging socket having a first engaging hole defined therethrough, said first engaging socket is rotatably engaged with respect to said ratchet box, said ratchet box further including a second engaging socket, said second engaging socket having a different diameter second engaging hole defined therethrough, said second engaging socket is rotatably engaged with respect to said ratchet box.

2. The wrench of claim 1 wherein said first engaging hole of said first engaging socket is a toothed 12 point engaging hole.

3. The wrench of claim 1 wherein said second engaging hole of said second engaging socket is a toothed 12 point engaging hole.

4. The wrench of claim 1 wherein said first engaging hole of said first engaging socket is a square engaging hole.

5. The wrench of claim 1 wherein said second engaging hole of said second engaging socket is a square engaging hole.

* * * * *